US006047405A

United States Patent [19]

Wilkinson

[11] Patent Number: 6,047,405

[45] Date of Patent: Apr. 11, 2000

[54] ENERGY EXPENDITURE GARMENT

[76] Inventor: William T. Wilkinson, P.O. Box 73, Salem, N.J. 08079

[21] Appl. No.: 09/243,960

[22] Filed: Feb. 3, 1999

Related U.S. Application Data

[63] Continuation-in-part of application No. 08/929,945, Sep. 15, 1997, Pat. No. 5,875,491.

[60] Provisional application No. 60/026,969, Sep. 20, 1996.

[51] Int. Cl.[7] ..... A41B 1/00

[52] U.S. Cl. ..... 2/69; 2/227; 2/228; 2/115; 482/120; 450/104

[58] Field of Search ..... 2/69, 79, 70, 228, 2/227, 238, 170, 108, 115, 102, 455, 456; 482/105, 120, 121, 124, 134, 74; 450/104

[56] References Cited

U.S. PATENT DOCUMENTS

| | | | |
|---|---|---|---|
| 3,759,510 | 9/1973 | Jackson, Jr. | 482/105 |
| 4,953,856 | 9/1990 | Fox, III | 482/105 |
| 5,109,546 | 5/1992 | Dicker | 2/70 |
| 5,267,928 | 12/1993 | Barile et al. | 482/105 |
| 5,570,472 | 11/1996 | Dicker | 2/69 |
| 5,659,895 | 8/1997 | Ford, Jr. | 2/69 |
| 5,737,772 | 4/1998 | Dicker et al. | 2/69 |
| 5,737,773 | 4/1998 | Dicker et al. | 2/69 |
| 5,819,322 | 10/1998 | Dicker et al. | 2/69 |
| 5,978,966 | 11/1999 | Dicker et al. | 2/69 |

*Primary Examiner*—Gloria M. Hale
*Attorney, Agent, or Firm*—Connolly Bove

[57] ABSTRACT

An energy expenditure garment incorporates various techniques for providing resistance to the bending movements of the wearer. Such techniques include having a plurality of different types of resistance means. One of the resistance means is weights.

17 Claims, 2 Drawing Sheets

ENERGY EXPENDITURE GARMENT

CROSS-REFERENCE TO RELATED APPLICATION

This application is a continuation in part of Ser. No. 08/929,945, filed Sep. 15, 1997 now U.S. Pat. No. 5,875,491 which, in turn, is based upon provisional application Ser. No. 60/026,969 filed Sep. 20, 1996.

BACKGROUND OF THE INVENTION

Various garments have been suggested which involve elastic elements to provide a resistance to an activity which would require the swinging or bending of the arms and/or legs and/or body. Generally, such elastic elements are elastic cords or bands which are separate from the remainder of the garment, but are otherwise attached to the garment or the elastic elements are in the form of elastic panels which are integral with the remainder of the garment. Examples of such garments described in patents are found in U.S. Pat. Nos. 5,109,546, 5,176,600, 5,186,701, 5,201,074, 5,306,222, 5,570,472, 5,700,231, 5,727,254, 5,708,976, 5,720,042, 5,737,773, 5,745,917, 5,819,322 and 5,839,122. Additional disclosures of such garments are found in various U.S. patent applications, namely, Ser. No. 840,917, filed Apr. 25, 1997, and Ser. No. 08/892,669, filed Jul. 14, 1997.

SUMMARY OF THE INVENTION

An object of this invention is to provide an energy expenditure garment which utilizes alternative techniques for providing resistance in the garment.

A further object of this invention is to provide techniques for enhancing the types of garments described in the above noted patent applications.

In accordance with one aspect of this invention an energy expenditure garment includes resistance elements in the form of panels integral with the base fabric wherein the panels are provided on the garment in a non-uniform manner in the sense, for example, that the panels on one side of the garment, such as on the right side of the front would be of a different pattern than on the other side, such as the left side of the front.

In accordance with another aspect of this invention the resistance in the garments is achieved by providing relatively non-elastic members which are joined together by friction elements or by elastic members such as springs or rubber bands.

In accordance with a further aspect of this invention the garment may be used for rehabilitation purposes wherein the garment is modified to include a stiffening member or insert between the elastic panel and the base fabric so as to support selected parts of the user's body.

THE DRAWINGS

DETAILED DESCRIPTION

The present invention relates to energy expenditure garments which could be of the types shown and described in the aforenoted patents and applications. All of the details of all of those patents and applications which are incorporated herein by reference thereto.

In accordance with one aspect of the invention an energy expenditure garment is provided which could be in the form of a one-piece or two-piece suit made from a base fabric wherein resistance elements are incorporated in the garment. In a preferred practice of the invention the resistance elements are panels which are secured to and thus integral with the base fabric. The panels may separate distinct portions of the base fabric and thus act as the structure which joins those portions of the base fabric together or the panels may overlie or underlie the base fabric. A general characteristic of the resistance elements as compared to the base fabric is that a different, preferably greater, resistance force is encountered in stretching the resistance elements and in resisting those elements from returning toward their original position than would be required for the base fabric.

Figure 1:
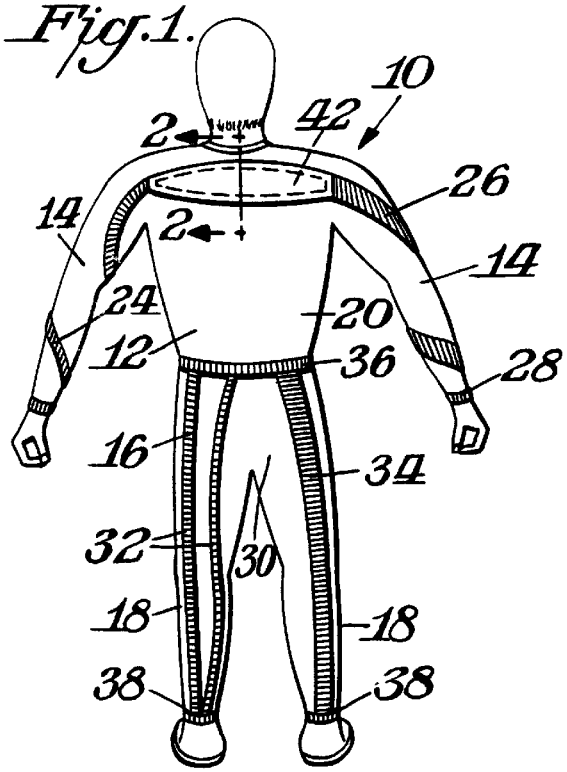
FIG. 1 is a rear elevational view showing a person wearing an energy expenditure garment in accordance with this invention.

FIG. 1 illustrates an energy expenditure garment 10 in accordance with this invention. As shown therein the garment 10 is in the form of a suit having a top or shirt 12 with elongated arms or sleeves 14. The suit also includes a pants portion 16 with elongated legs 18. Shirt or top 12 is made of a base fabric 20 and includes resistance elements 24,26 which extend up the arms and to the body portion of shirt 12. The ends of the resistance elements are anchored in any suitable manner such as by compression cuffs 28. Other forms of anchoring could be hand loops or gloves.

Pants 16 is made of a base fabric 30 and includes sets of resistance panels 32,32 on one leg and a panel 34 on the other leg. The upper ends of the various resistance panels are anchored by compression waistband or belt 36 and by ankle cuffs 38. Other forms of anchoring, such as footwear or stirrups could also be used.

Figure 2:
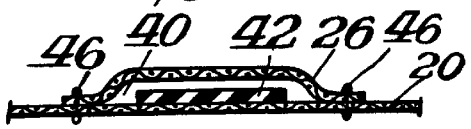
FIG. 2 is a cross-sectional view taken through FIG. 1 along the line 2—2.

FIGS. 1–2 exemplify a modification in accordance with this invention wherein the garment 10 would be particularly suitable for rehabilitation programs. In such programs it is desirable that the garment be used as a low impact way to build strength and facilitate or speed recovery. The garment could also be used as part of the treatment of injuries. As shown the base fabric 20 has the resistance panels superimposed thereover. Ordinarily, the panel would be disposed in surface to surface contact with the base fabric. As illustrated in FIGS. 1–2, however, panel 26 is formed over a portion of the base fabric in spaced relation to the base fabric so as to create a pocket 40. An insert 42 is mounted in the pocket. For purposes of illustration and clarity in understanding this invention, the pocket 40 is shown to be oversized with respect to insert 42. In practice, however, panel 26 would fit snugly around insert 42. Insert 42 is preferably made of a material imparting some degree of rigidity to a selected area of the garment so as to provide support to the user in areas which are, for example, injured or otherwise should be supported. FIG. 1 illustrates the insert 42 to be located across the shoulder area in the rear of the garment. Other inserts would be suitable at other locations in accordance with the needs of a particular user undergoing rehabilitation. Thus, the inserts 40 would be of rigid or semi-rigid form having less elastic resistance characteristics than the resistance elements which overlie the insert.

An alternative to having the insert in a pocket would be to use a stiffening insert to connect two elastic bands and locate the insert at an area of the wearer's body to be supported.

FIG. 1 illustrates a further aspect of this invention which differs from conventional structures. In this regard, conventional structures generally provide the resistance elements in a balanced manner, that is in a manner wherein there is equal force on the front and backs of the legs, arms and torso and in a symmetrical manner where the forces are equal on the right hand side as compared to the left hand side. In accordance with FIG. 1, unequal forces are provided by having resistance elements of different characteristics. Thus, FIG. 1 shows the resistance band 24 to be thinner and to be spirally arranged around its arm in a manner different than the resistance band 26 on the opposite arm. Similarly, the resistance bands 32 on one leg are of different resistance characteristics than the band 34 on the other leg. As illustrated, for example, band 34 is wider than the bands 32. A further difference is in the number of bands in that two bands 32 are provided on one leg as compared to only a single band on the other leg. The use of unequal forces is desirable to provide stronger elastic structures which oppose large muscle groups and weaker elastic structures to oppose smaller muscle groups or vise versa.

In accordance with another aspect of this invention the resistance could be provided by various relatively non-elastic techniques used alone or in combination with elastic techniques. Such non-elastic techniques could include, for example, the provision of weights on the garment or a form of friction brake such as a friction brake with cords or bands, panels, etc. Other forms of elastic techniques such as springs, bands, or rubber bands could be used in combination with elastic or non-elastic cords, panels, etc.

A particularly advantageous alternative is the use of a nonelastic friction drag mechanism. Reference is made to U.S. Pat. No. 5,460,586 all of the details of which are incorporated herein by reference thereto which describes the use of a treadmill having resistance poles mounted thereto wherein the resistance is adjustably obtained through the use of a friction brake mounted on a shaft in combination with a control knob. Such type of friction brake could be mounted on the garment at the joints such as elbows, knees, shoulders, ankles, etc. where movement of the body would be resisted by an adjustable friction brake or by spring tension, or by a piston-cylinder arrangement. All of these variations involve a resistance connection between to preferably non-elastic elements.

Figure 3:
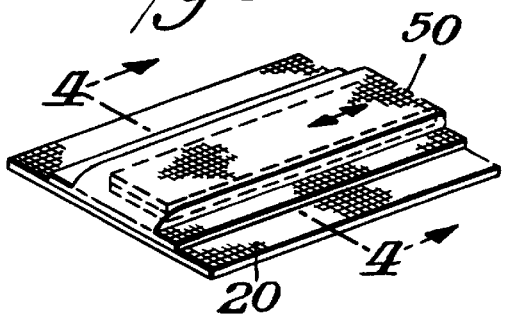
FIG. 3 is a fragmental perspective view showing a portion of an energy expenditure garment in accordance with a further aspect of this invention.
Figure 4:
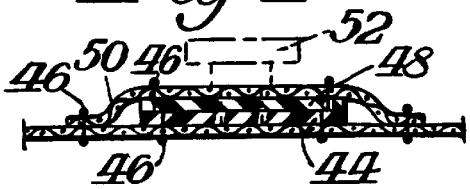
FIG. 4 is a cross-sectional view taken through FIG. 3 along the line 4—4.

FIGS. 3–4 illustrate a practice of the invention utilizing a friction brake mechanism to apply the resistance connection. As shown therein a friction pad 44 is permanently secured to base layer 20 in any suitable manner such as by fastening elements 46. Friction pad 44 would extend from a joint and then continue along a portion of the body that does not bend such as, for example, the upper arm. A second friction pad 48 is disposed over and in frictional contact with friction pad 46. Friction pad 48 may extend down the forearm and overlap friction pad 44 at the elbow. If desired, a cover 50 could be secured over the friction pads 46,48 to create a pocket for the friction pads and to confine the friction pads against lateral or outward movement so that the only movement is a relative surface to surface movement in a longitudinal direction back and forth in accordance with the bending of the elbow. Cover 50 could be secured by any suitable fastening elements 46 to base fabric 20 and upper pad 48.

If desired the amount of friction could be adjusted by incorporating a control knob 52 shown in phantom in FIG. 4 which would extend through cover 50 for engagement, for example, with a nut in cover 50 so that the threaded control knob could be selectively moved to push friction pad 48 into closer engagement with friction pad 44 or to permit the amount of friction to be lessened by moving knob 52 outwardly away from pad 44.

In use when the wearer bends the arm at the elbow, or at any other joint incorporating the friction brake, a resistance to movement would be encountered by the rubbing of one friction pad against the other so that a greater force is exerted than if no friction brake were present.

The invention could also be practiced where a garment includes one or more elastic sections mounted to one or more non-elastic sections or elastic sections with different elasticity (resiliency) characteristics. Thus, for example, an elongated cord could be provided in sections where various sections are elastic and other sections are non-elastic or of different elasticity. Preferably the sections are detachably mounted together so that the net result would be the ability to have variable elasticity by substituting different types of sections either elastic or non-elastic for other sections.

Figure 5:
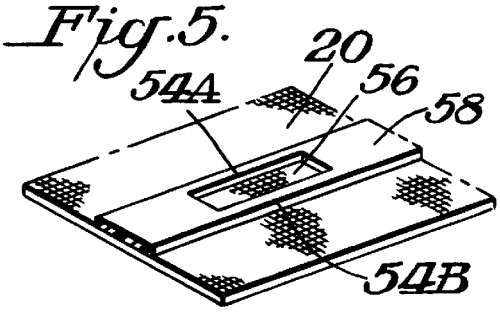
FIG. 5 is a fragmental perspective view of a portion of a garment in accordance with another aspect of this invention.

FIG. 5 illustrates a variation of the invention wherein the elastic strip or panel has a cut-out 56 thereby reducing the resistance characteristics in the portions of the panel having the cut-out since only two narrow strips 54A and 54B are located at the cut-out, in contrast to the wide continuous strip on each side of the cut-out.

Figure 6:
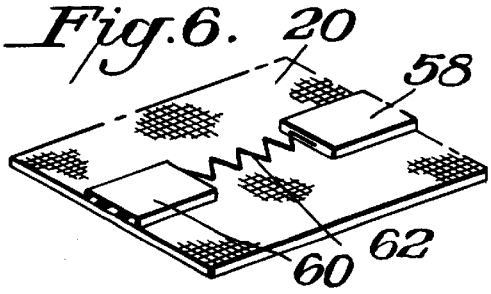

FIG. 6 shows a variation of the invention wherein a pair of elastic or non-elastic bands or panels 58,60 are interconnected by a spring 62 with the unit being mounted on base fabric 20. The resistance is thus afforded primarily by the stretching or contraction of spring 62 rather than by the elasticity of the panels 58,60. Thus, panels 58,60 could be of the same or even lesser elasticity than base fabric 20 yet the desired resistance affect would be achieved by means of spring 62.

Figure 7:
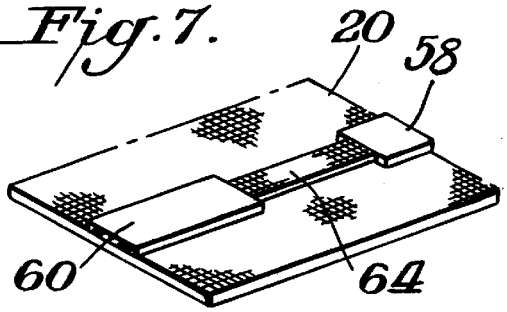
FIGS. 6–7 are views similar to FIG. 5 showing yet other variations of this invention.

FIG. 7 shows a variation of the embodiment shown in FIG. 6 wherein an elastic band, such as a rubber band 64 is used instead of a spring to interconnect the panels 58,60.

Figure 8:
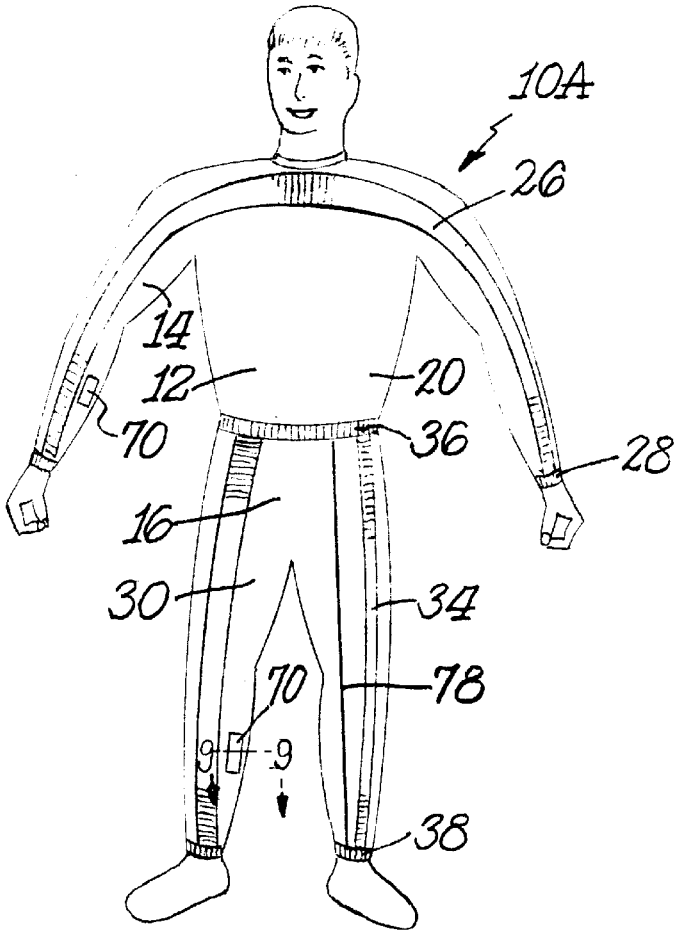
FIG. 8 is a front elevational view showing a person wearing a modified form of garment in accordance with this invention.
Figure 9:
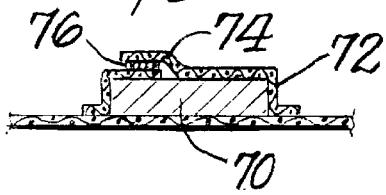
FIG. 9 is a cross-sectional view taken through FIG. 8 along the line 9—9.

As previously noted, the invention could be practiced by using non-elastic techniques alone or in combination with elastic techniques. Such non-elastic techniques could include the provision of weights on the garment. FIGS. 8–9 illustrate such practices of the invention. As shown therein a garment 10A is provided with various forms of resistance means, such as previously described, which includes, for example, elongated elastic resistance elements 26,34. Garment 10A also includes the use of weights as further resistance means. For example, weights 70 could be mounted to garment 10A at various suitable locations. Preferably the weights are mounted on the limbs where there is the greatest movement. Accordingly, when a user moves the arms or legs the weights would add a resistance force which would enhance the use of the garment. The weights could take any suitable form such as heavy blocks or bars permanently or detachably mounted to the garment. Such blocks might be included, for example, in pockets. FIG. 9 illustrates a pocket 72 formed with a flap 74 having a hook and loop structure 76 to readily permit the pocket to be opened so that one weight 70 could be replaced by a heavier or by a lighter weight. It is to be understood that although FIG. 8 illustrates only one weight on one arm and one weight on one leg, preferably the weights would be used in sets, where, for example, each arm and/or each leg would have a weight. The weights could also be provided on other portions of the garment, such as on the body portion of the shirt 12 or on the body portion of the pants 16.

The weights could take any suitable form. For example, the blocks or bars could be of rectangular cross-section or be in the form of rods of circular cross-section. Similarly, each pocket 72 may, itself, include one or more individual weights.

FIG. 8 also illustrates a variation wherein heavy weighted threads 78, such as metal threads are sewn into the garment at suitable locations to provide a different form of weights. The threads could also be in the form of non-elastic strips or bands. Any suitable number of threads could be sewn into or secured at any suitable locations. Preferably, the threads would extend longitudinally along the limbs with threads on each leg and/or sleeve of the garment.

It is to be understood that the invention may be practiced where there are at least three different types of resistance means such as the elastic resistance elements, the weights and other forms of non-elastic resistance means as previously described.

As is apparent, the various embodiments described above show different manners of enhancing the resistance characteristics of the energy expenditure garment. Further enhancement could be achieved not only in connection with the wearing of the garment but also by modifying the techniques of performing an activity. Thus, for example, during a walking movement the user might in addition to swinging the arms also twist the hands at the wrist sections inwardly or outwardly to gain added resistance.

It is to be understood that the above detailed description represents exemplary manners of practicing the invention. Various of the features shown in one embodiment can be incorporated with other embodiments within the spirit of this invention. Thus, for example, the unequal force feature illustrated in FIG. 1 could be incorporated with the specific manners of applying resistance such as in the other embodiments. It is also to be understood that the garment itself may be of any of the types of constructions described in the aforenoted patents and patent applications. Thus, the garment could be a two-piece suit such as illustrated in FIG. 1 or a one-piece suit.

What is claimed is:

1. In an energy expenditure garment comprising a body portion having outwardly extending limb portions, said body portion and said limb portions being made of a base fabric, the improvement being in that said garment includes a plurality of different types of resistance means which have resistance characteristics whereby the force required for a user to move a part of the user's body is greater than the force required for stretching said base fabric and resisting said base fabric from returning toward its original condition in the absence of said resistance means.

2. The garment of claim 1 wherein one of said plurality of different types of resistance means comprises weights on said garment.

3. The garment of claim 2 wherein one of said plurality of different types of resistance means comprises elongated elastic resistance elements.

4. The garment of claim 3 wherein said plurality of different types of resistance means are located on said limb portions.

5. The garment of claim 4 wherein said weights comprise weighted bars.

6. The garment of claim 5 wherein said weighted bars are non-removably mounted to said garment.

7. The garment of claim 5 wherein said weighted bars are detachably mounted to said garment.

8. The garment of claim 7 wherein said weighted bars are located in pockets on said garment.

9. The garment of claim 4 wherein said weights comprise elongated weighted threads secured longitudinally in said limb portions.

10. The garment of claim 4 wherein said weights are located at a plurality of spaced locations.

11. The garment of claim 10 wherein said body portion comprises a shirt, said limb portions being sleeves, and said weights being at said sleeves.

12. The garment of claim 11 wherein said body portion further comprises pants, said limb portions further comprising legs, and said weights further being in said legs.

13. The garment of claim 12 wherein said shirt and said pants are joined to form a one piece suit.

14. The garment of claim 10 wherein said body portion comprises pants, said limbs being legs, and said weights being at said legs.

15. The garment of claim 2 wherein said plurality of different types of resistance means comprises at least three different types.

16. The garment of claim 15 wherein one of said plurality of different types of resistance means comprises elongated elastic resistance elements.

17. The garment of claim 16 wherein one of said plurality of different types of resistance means is non-elastic.

* * * * *